United States Patent [19]

de Lima Castro Netto

[11] 4,197,982

[45] Apr. 15, 1980

[54] DEVICE FOR THE INVIOLABLE CLOSING OF BAGS

[76] Inventor: Eduardo de Lima Castro Netto, Rua São Luiz Gonzaga 912, São Cristovão, Rio de Janeiro, Brazil

[21] Appl. No.: 923,748

[22] Filed: Jul. 11, 1978

[30] Foreign Application Priority Data

Oct. 20, 1977 [BR] Brazil ..... 7707029

[51] Int. Cl.[2] ..... B65D 33/16

[52] U.S. Cl. ..... 229/62; 24/30.5 R; 150/11; 150/15; 229/63; 292/307 R

[58] Field of Search ..... 229/62, 63, 65; 150/3, 150/15, 23-27, 16-20, 11; 24/30.5 R; 292/307 R, 317, 319

[56] References Cited

U.S. PATENT DOCUMENTS

| | | | |
|---|---|---|---|
| 293,459 | 2/1884 | Hawn | 150/18 |
| 295,733 | 3/1884 | Campbell | 150/18 |
| 348,965 | 9/1886 | Gunn | 150/17 |
| 374,845 | 12/1887 | Moss | 150/17 |
| 686,948 | 11/1901 | Nason | 150/19 |
| 1,055,002 | 3/1913 | Varnum | 24/30.5 R |
| 2,563,616 | 8/1951 | Perino | 150/11 |
| 2,951,273 | 9/1960 | Brenker | 229/65 |

FOREIGN PATENT DOCUMENTS

| | | | |
|---|---|---|---|
| 559682 | 3/1957 | Italy | 150/3 |

*Primary Examiner*—Stephen P. Garbe

*Attorney, Agent, or Firm*—Beveridge, DeGrandi, Kline & Lunsford

[57] ABSTRACT

A device for closing and sealing bags which eliminates the tightening of the mouth, and makes the operation simple, rapid and safe. The device, according to the invention, comprises a flat housing with an open bottom which receives the folded mouth (preferably two series of folds reminiscent of an accordion) of a bag. An element is extended between the two larger sides of the housing, passing through aligned orifices in the folded mouth of the bag. This effects immobilization between the element and the two larger sides. In the preferred embodiment, the element is, in reality, two lengths of cord fixed to one of the larger sides and freely passing across the other. In this case, the larger sides form part of two halves of the housing, which are separable for opening the bag. In the closed position, the two halves can be locked and sealed.

14 Claims, 15 Drawing Figures

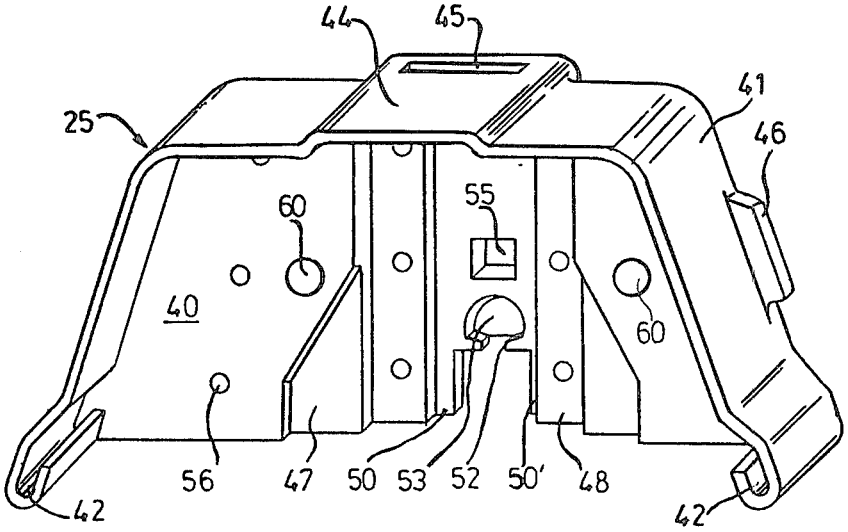
FIG. 9
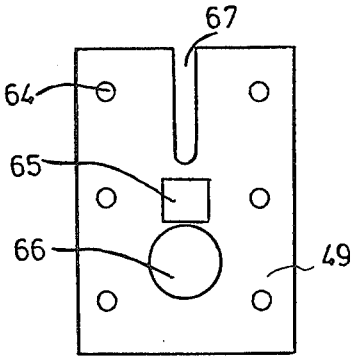
FIG. 10
FIG. 11
FIG. 12
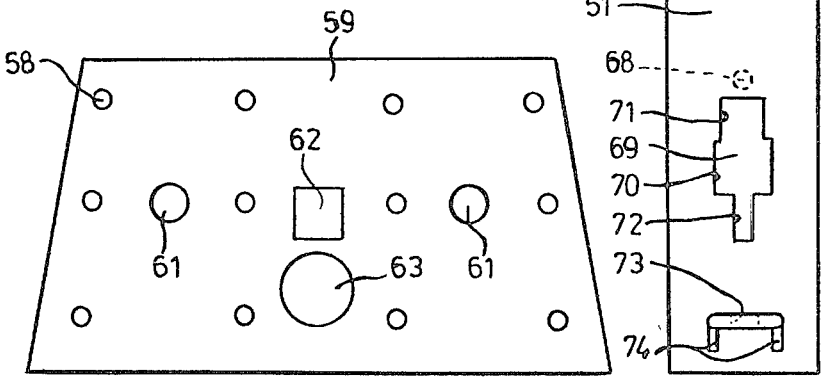

DEVICE FOR THE INVIOLABLE CLOSING OF BAGS

Bags are conventionally closed by means of string tightened in the region below the mouth. The string is then tied and sealed by using a security seal, that is to say, a normal lead seal, or nowadays by metal or plastic seals. The gathering of the neck of the bag and the tightening of the string give rise to many problems and disadvantages, because insufficient tightening will permit an unauthorized person to insert a tool through the mouth of the bag and along the interior of the neck, thus reaching its contents. Insufficient tightening also sometimes permits the whole closure assembly (string, seal, label and the like) to be slipped to the top and, for the purpose of impeding its total removal from the bag, the size of the mouth has to be enlarged, usually by means of a hem forming a tunnel which receives a cord. This makes the bag more expensive.

Apart from the considerable tightening necessary to form the neck of the bag, such tightening has to be maintained while the string is firmly tied and/or the seal is applied. This is problematic because it makes it more difficult for the closing of bags by women.

Yet another disadvantage of the majority of bag closing systems based on tightening, is the limited use of the space in the bag due to the fact that the neck is not in the mouth, but some way below. This disadvantage has been overcome by a bag formed with a series of orifices around the mouth. For the purpose of closing the bag, the mouth is folded a number of times so that all the holes are aligned. A rod is then passed through the holes and tightened. A butterfly-type nut, used for tightening, has a hole in one of the "wings" which permits the placing of a lead seal and wire, fixing the nut in relation to a metal backing plate which forms part of the tightening system. Such closing system, it is true, is of high security, but is also expensive and time-consuming.

The present invention has the purpose of eliminating the disadvantages connected with the act of tightening bags during their closure without the necessity to resort to satchel-type bags in which there is no reduction nor tightening of the mouth during closing, but rather an upper edge which is folded over the mouth and then fixed by string and then sealed to the side of the bag.

The present invention therefore refers to a device for closing bags of the type which comprises a housing, generally flat, having a top wall, a pair of larger opposite side walls and a pair of smaller opposite side walls, with an open bottom destined to receive, in a folded condition, the mouth of a bag, at least one element destined to be stretched between the said two larger side walls, usually parallel to the said top wall, and immobilizing means permitting substantial immobilization of said element with respect to the said two larger walls. According to the present invention wherein the problem of having to tighten bags during closure is resolved by a system which substantially eliminates any tightening by covering the folded mouth of the bag in a way which prevents unauthorized access to its interior, a first embodiment is such that the mouth of the bag has a series of holes or orifices, which are aligned by means of multiple folding, it then being inserted inside the housing through the open bottom until the aligned holes are also aligned with openings formed at a certain height in the said larger side walls. The said element in the form of a rod is inserted through the assembly, including the holes in the bag, until it projects beyond the second larger wall of the housing, where adequate formations permit its immobilization by means of a security seal.

In a second embodiment of the invention, which is presently preferred, there are two of said elements, in the form of two lengths of string, permanently connected with one of the larger walls of the housing. Again the bag has the holes around the mouth, but is folded in the form of an accordion, to define two parallel series of aligned holes defining a mouth having two sides of multiple folds. Each length of string is permanently threaded through a respective one series of the two series of holes and then through a respective opening in the second of the larger walls of the housing. In this preferred embodiment, however, the housing itself is divided, that is to say, in two halves based on the two larger walls. To close the bag, the second larger wall is placed near the first, using the lengths of string as a guide, until the housing is closed with the mouth of the bag held in its interior by the lengths of string. Here, the immobilizing devices comprise means for maintaining the housing together as a single unit until the bag is to be opened.

The invention will now be described in more detail, by means of example, with reference to the attached drawings, in which:

FIG. 9 is a perspective view of the front half of the bag closure housing shown in FIG. 4;

FIG. 10 shows a first metal plate connected with the half illustrated in FIG. 9;

FIG. 11 shows a locking slide;

FIG. 12 shows a backing plate associated with the half illustrated in FIG. 9;

Figures 1, 2:
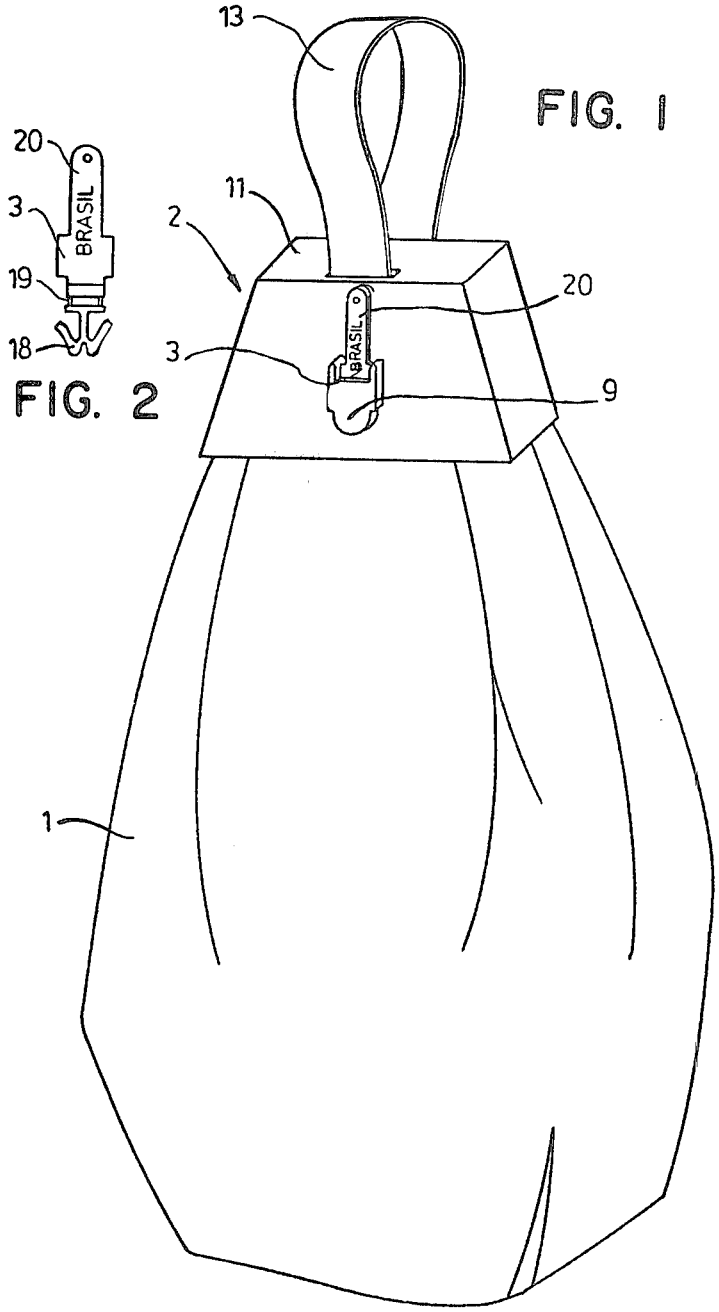
FIG. 1 is a perspective view of a closed and sealed bag, in accordance with one embodiment of the present invention.
FIG. 2 shows the security seal used in the embodiments of FIGS. 1 and 4.
Figure 3:
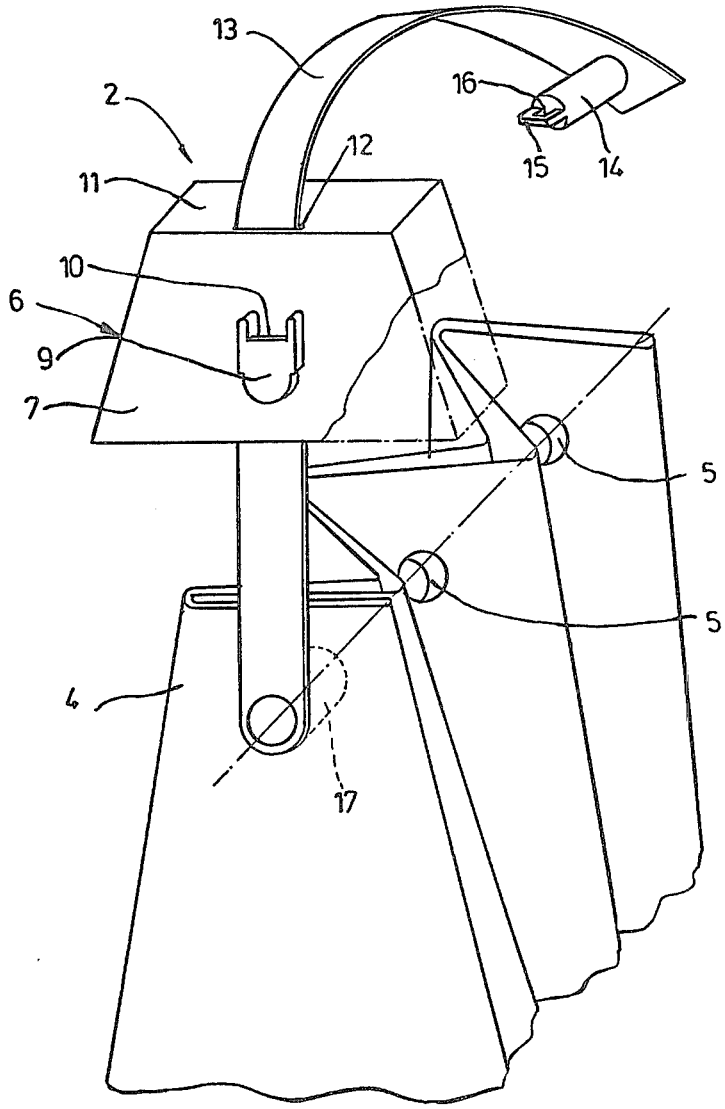
FIG. 3 is a perspective view of the bag closing device of FIG. 1 and the mouth of the bag, during the closing operation.

Referring first to FIGS. 1, 2 and 3 of the drawings, a bag 1 is closed by means of a bag closing device 2, constructed according to this invention and sealed by means of a security seal 3 (FIG. 2).

The bag 1 can be any bag conventionally used by the post office or by companies transporting valuables, that is to say, canvas bags. However, the proved ease with which canvas bags can be violated by cutting the stitching and later re-sewing, makes their use inadvisable. In accordance with an aspect of the present invention, it is preferable that the bag be made from any adequately reinforced electronically welded plastic (fiberglass or similar) to ensure its durability. The violation of such a bag is easily detected because no violator would have the facility of taking the bag to an electronic welding machine, while any cut would have to be glued afterwards, which could be detected without any major problem.

The mouth 4 of the bag 1 is formed around its periphery with a series of holes 5 (twelve in the bag illustrated in FIG. 3) for cooperation with part of the bag closing device 2.

Considering now more specifically FIG. 3, the bag closing device 2 comprises a flat housing with an open bottom. The housing is shaped to receive the mouth 4 of the bag, when folded (in the manner illustrated) and lightly compressed. The two larger opposite walls 7 and 7' are therefore trapezoidal, being centrally formed with respective aligned circular openings. Integral with the side wall 7 there is a capsule 9 with an open bottom covering the respective circular opening mentioned above and having a lateral opening 10 to receive the security seal 3.

The top wall 11 of the housing 6 is slit at 12 adjacent the edge of the side wall 7. The bag closing device 2 also comprises a strap 13 which freely passes through slit 12 at the top 11 of the housing. One end of the strap 13 has fixed thereto a solid cylindrical rod 14 of an external diameter slightly less than the aligned openings in the larger walls 7 and 7'. The free end of the rod 14 is formed with a small rectangular ring or bridge 15 defining a transverse opening 16 identical to the lateral opening 10 in the capsule 9.

To make it easier to apply the device 2 to the bag 1 and to ensure that it does not separate into two parts due to strap 13 escaping through slit 12, the other end of the strap has a small tube 17 having a length substantially equal to the internal separation between the walls 7 and 7', an external diameter slightly less than the diameter of the hole 5 in the mouth 4 of the bag and an internal diameter substantially equal to the openings in the walls 7 and 7'.

The operation of closing the bag 1 of FIGS. 1 and 3 comprises the following steps:

(a) fold the mouth 4 to align the holes 5, at the same time inserting therethrough the small tube 17 at the end of strap 13 (FIG. 3);

(b) when the mouth 4 is totally folded, with all the folds over the tube 17, pull the strap 13 upwards until the assembly of the tube 17 and the mouth of the bag 4 are inside the housing 6 with the bore of the tube 17 aligned with the openings in the larger walls 7 and 7', respectively; and (c) insert the rod 14 through the opening in the wall 7' of the tube 17 and the opening in the wall 7, in such a way that the bridge 15 is received inside capsule 9 with its lateral opening 16 aligned with the substantially identical opening 10 in capsule 9.

The bag is now closed and the strap 13 can be used as a handle. It should also be observed that the closing operation was completed easily without any physical effort of tightening. The assembly will be sealed by means of seal 3 (FIG. 2) which is applied manually, inserting the head 18 through the said openings 10 and 16, in a way that the side arms are held within the capsule 9 behind the bridge 15 in the rod 14. The weakenings 19 connecting the head 18 of the seal with a blade portion 20, then lie between the openings 10 and 16, in a way that the rupture of the bridges (authorized opening) permits the removal of the rod 14, the head 18 of the seal falling through the open bottom of the capsule 9. For a more complete description of the security seal 3, the capsule 9 and the bridge 15, reference is made to my U.S. Application Ser. No. 670,318 filed on Mar. 25, 1976 now U.S. Pat. No. 4,106,801.

Figure 4:
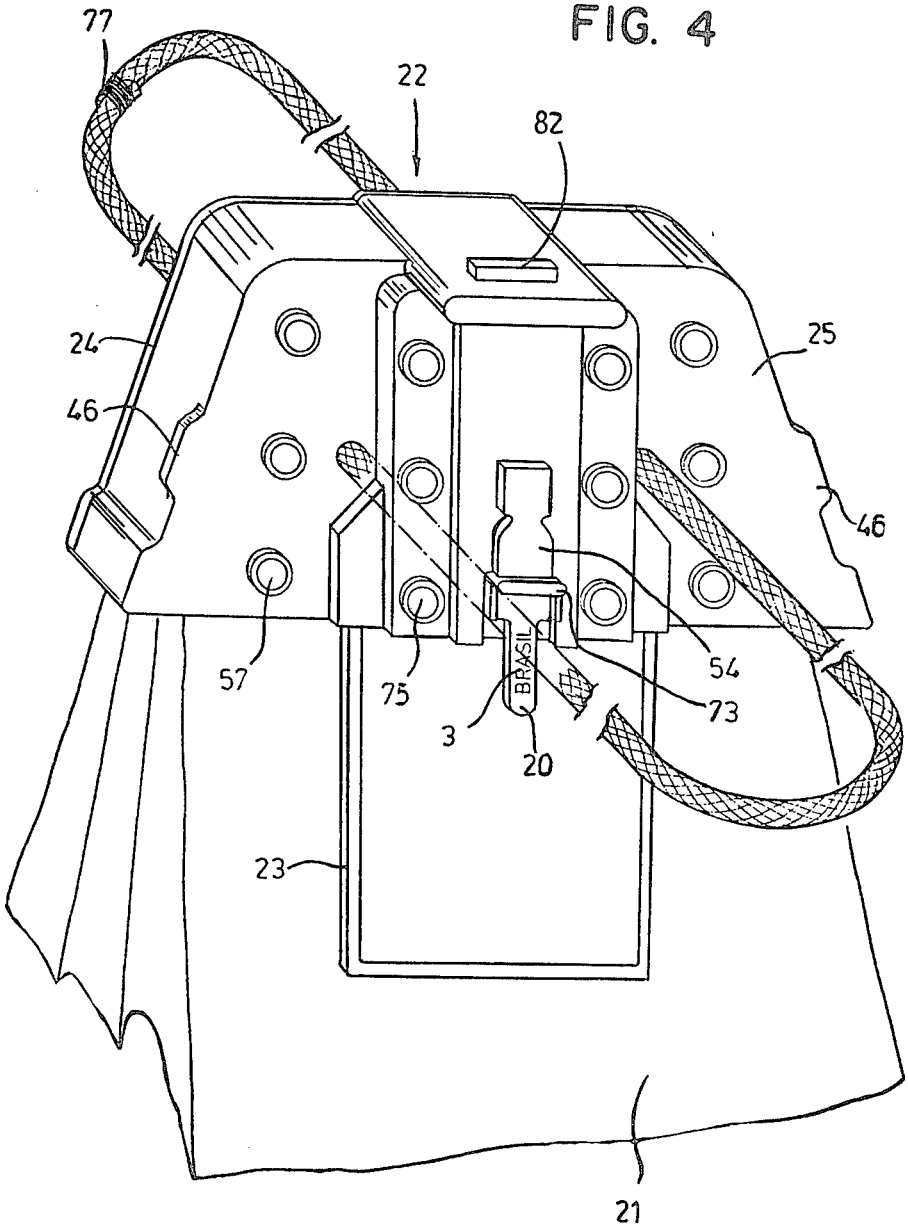
FIG. 4 is a perspective view of a bag closed and sealed in accordance with the presently preferred embodiment of the invention.
Figure 5:
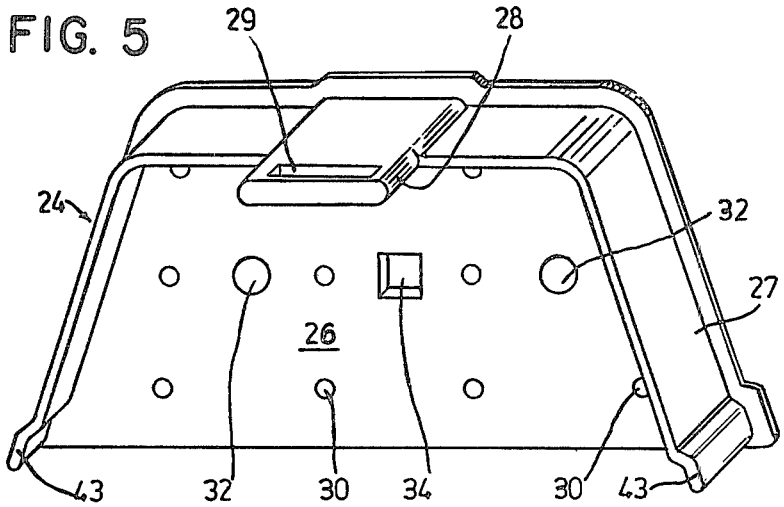
FIG. 5 is a perspective view of the rear half of the bag closure housing shown in FIG. 4.
Figure 6:
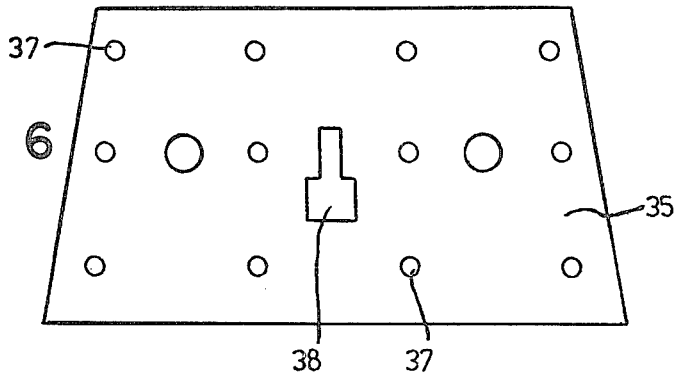
FIG. 6 shows a backing plate associated with the half illustrated in FIG. 5.
Figure 13:
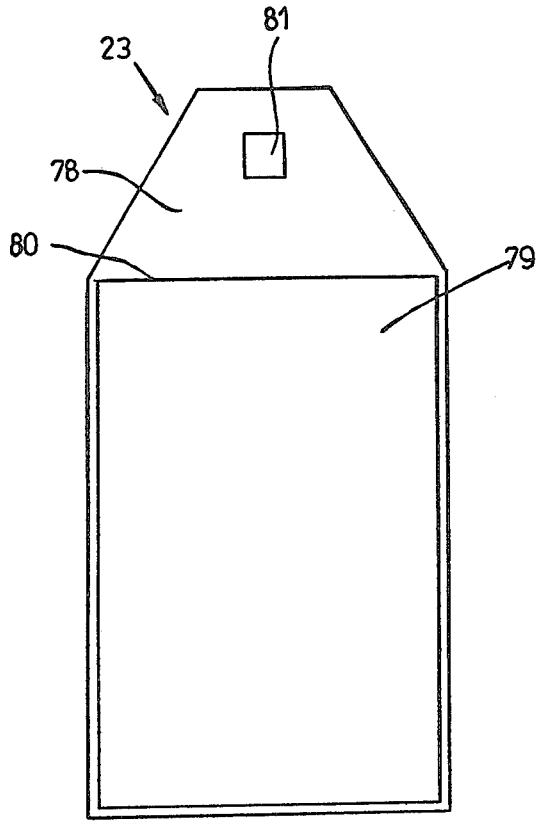
FIG. 13 is a label holder used in the device.

Turning now to FIGS. 4–15, these show the presently preferred embodiment of the invention and, to facilitate understanding of the detailed description which follows, FIG. 4 illustrates a bag 21 of construction and material similar to the bag 1 of FIG. 1, closed by a bag closing device 22, sealed by seal 3 of FIG. 2 and provided with a label holder 23 (FIG. 13).

The bag closure 22 comprises a housing for the mouth of the bag, in the form of a rear half 24 (FIG. 5) and a front half 25 (FIG. 9) which are distinct and separable with respect to each other. Rear half 24 has a generally trapezoidal main wall 26 formed internally of its upper edge and of its side borders, with a flange 27 normal thereto. Centrally of the upper length of the flange 27, is a thicker part which projects beyond the flange to define a projection 28 formed with a through slot 29. The main wall 26 of rear half 24 is perforated a number of times (twelve in the drawings) at 30 to receive rivets 31 (see FIG. 14) and twice at 32 to allow passage therethrough of the lengths of cord 33 (see FIG. 14). Approximately halfway up, wall 26 is formed with a rectangular cavity 34 which is open at least on the inner side seen in FIG. 5.

Figure 7:
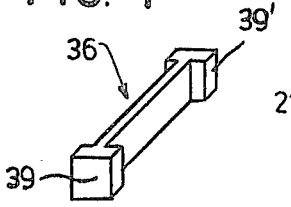
FIG. 7 shows a locking pin.
Figure 14:
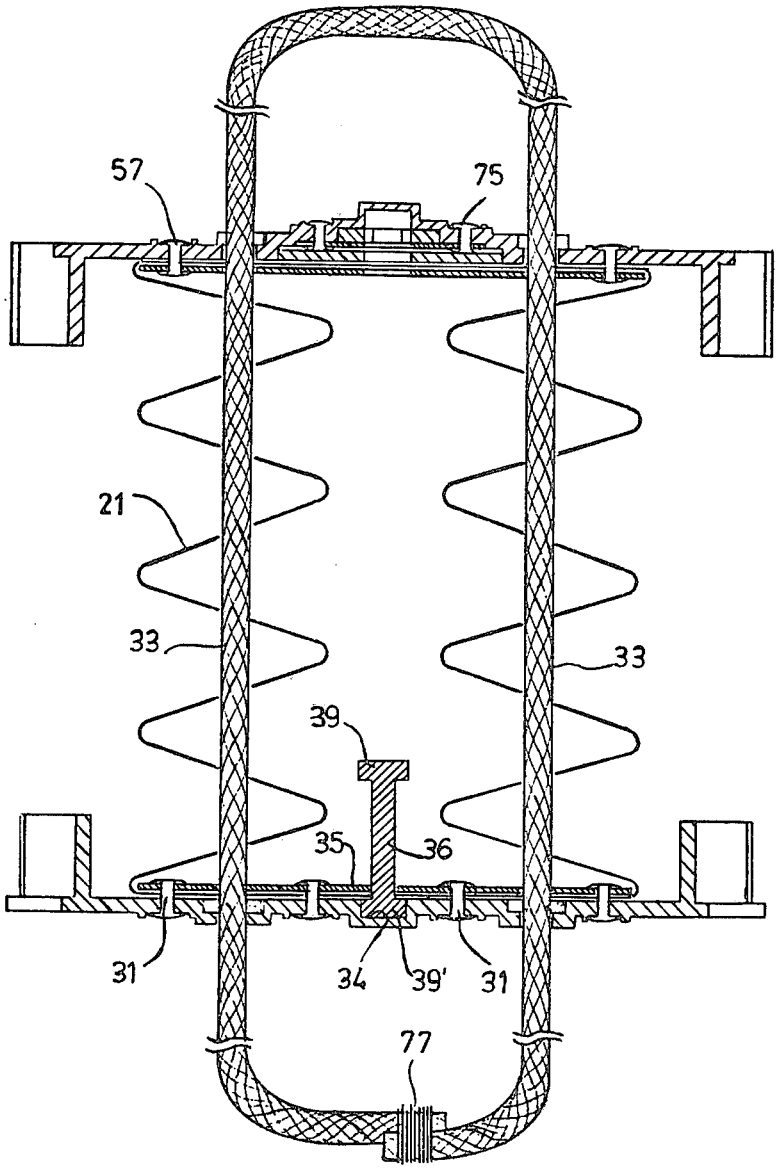
FIG. 14 is a plan view of the mouth of the bag during the closing of the device illustrated in FIG. 4.

Associated with the rear half 24 are a metal backing plate 35 (FIG. 6) and a pin 36 (FIG. 7). The backing plate 35 is shaped to cover wall 26 internally and is also perforated at 37 to receive the same rivets 31 (FIG. 14). In the center, plate 35 is formed with an opening 38 having a rectangular part of dimensions identical to those of the cavity 34 in wall 26, but at a lower position, and a narrower part destined to overlap cavity 34 in the assembled condition.

The pin 36 illustrated in FIG. 7 has a relatively narrow body of dimensions similar to the narrow part of opening 38 and two rectangular heads 39 and 39' of a size equal to the cavity 34.

The rear half 24 of the device is permanently fixed in the mouth of the bag 21 in the manner best seen in FIG. 14. A region of the periphery of the mouth of bag 21 is suitably perforated (in accordance with the holes and cavities in wall 26 and backing plate 35) and is then fixed between the wall 26 and the plate 35, where the assembly, including the pin 36 and the two lengths of cord 33, is fixed by means of rivets 31, as will be described later in detail.

The other front half 25 of the split housing is illustrated in FIG. 9, while the parts to be fixed thereto are shown in FIGS. 10, 11 and 12. Referring first to FIG. 9, half 25 has a substantially trapezoidal main wall 40 having an outline identical to main wall 26 of rear half 24, and a flange 41 extending from its side and upper edges. The flange 41 has an inner surface which corresponds to the external surface of flange 27 of rear half 24 in such a way that the latter fits within the former. For the purpose of better defining the fit and for eventually increasing the security of the device 22 when closed and sealed, the lower ends of flange 41 are turned inwards and upwards, defining channels 42 which receive the mating ends 43 of flange 27 on half 24.

The upper part of flange 41 is also shaped to define a hollow projection 44, adapted to receive projection 28 on rear half 24, and a slot 45 which is aligned in the closed position with slot 29.

On its side extensions, the flange 41 is formed with lugs 46 (see also FIG. 4) which facilitate the opening of the bag.

The main wall 40 is molded to define a series of matching cavities. The first shallow cavity has partly vertical, partly sloping walls, as can be seen at 47, to receive the upper part of the label holder 23 (FIG. 13), which has a corresponding shape and is guided to the appropriate position by the sloping sides of cavity 47.

The second cavity 48 is vertical, passing up the middle of cavity 47, and serves to receive in a fixed position a metal plate 49 illustrated in FIG. 10, while the third cavity 50, also vertical, but narrower than the second cavity 48, receives in a slide a lock 51, illustrated in FIG. 11. It will be observed that the bottom of the third cavity 50 has a rectangular cut-out 50' starting from the lower edge of half 25, which terminates in a neck 52 leading to a generally circular orifice 53. The neck 52 and the orifice 53 are externally covered by a capsule 54 (see FIG. 4) which is somewhat similar to the capsule 9 shown in FIG. 1.

Finally, the bottom of the third cavity 50 is formed with a fourth cavity 55 identical in shape, size and position to the cavity 34 in the other half 24. The cavity 55 is destined to receive the rectangular head 39 of the pin 36 illustrated in FIG. 7.

The front half 25 is also perforated a number of times at 56 to receive rivets 57 (FIG. 14), as is also at 58 a metal backing plate 59 (FIG. 12). The half 25 is formed with two orifices 60 for the two lengths of cord 33 (FIG. 14). The backing plate 59 has corresponding orifices 61 for the cord, a rectangular opening 62 corresponding to the cavity 55 and one more circular orifice 63 destined to be aligned with the orifice 53 in the third cavity 50 of half 25.

The metal plate 49 (FIG. 10) has six perforations 64 to receive rivets, a rectangular opening 65 corresponding to the cavity 55 and a circular orifice 66 corresponding to the orifices 53 and 63. The plate 49 is also axially slotted at 67.

With reference to FIGS. 11 to 15, the slide or lock 51 has a small stop pin 68 which runs inside the slot 67 in plate 49 during use, and an opening of three widths 69, that is to say, a larger central rectangle 70, an upper rectangle of medium size 71 and a lower narrower rectangle 72. The slide 51 is formed near its lower end with a bridge 73 and two lateral guides 74 to guide and receive the security seal 3 (FIG. 2). The bridge 73 is formed with a rectangular seal receiving opening which is identical to the opening 16 in the bridge 15 of the first embodiment (FIG. 3). The bridge 73 also projects upwards so that, when the slide 51 is assembled in the device (FIG. 15), it abuts against capsule 54 behind orifice 53 in the half 25.

For the purpose of assembling the front half 25 of the bag closing device 22, the slide 51 (FIG. 11) is placed in the third cavity 50 (FIG. 9) with the bridge 73 and the guides 74 fitted in the cut-out 50' and projecting therefrom. The pin 68 in slide 51 extends inwardly, that is to say, away from the paper as seen in FIG. 9. Plate 49 of FIG. 10 is then placed over the slide with pin 68 fitted in slot 67. The plate is supported on the bottom of the second cavity 48, and fixed by means of six rivets 75 passing through aligned orifices 64 and 56.

It should be observed that the cavity 55 and the capsule 53 are aligned, respectively, with the opening 65 and the orifice 66, in the half 25 and the plate 49. The slide 51, in its turn, is slidingly held in the third cavity 50, and cannot be withdrawn owing to the interference between the pin 68 and the bottom of slot 67. When the slide is drawn out to the maximum, until stopped by pin 68, the medium size section 71 of opening 69 becomes aligned with cavity 55, which is of the same size, and the larger portion 70 of the same cavity aligns with the capsule 53.

The complete device is assembled on the bag in the manner best seen in FIG. 14. A cord 33 has its free ends introduced through the orifices 60 in the front half 25, after passing through suitable orifices made around the mouth of the bag 21. They then pass through the orifices 61 in the metal backing plate 59. The front half 25 and the plate are then placed against each other, sandwiching a section of the periphery of the mouth of the bag, such disposition being maintained by the application of rivets 57.

The upper periphery of the mouth of the bag 21 has two series of perforations around it on each side of the region where the half 25 and its associated components are fixed, and the two free ends of the cord 33 are then threaded through such perforations to define a bellows or accordion, as illustrated in FIG. 14.

Figure 8:
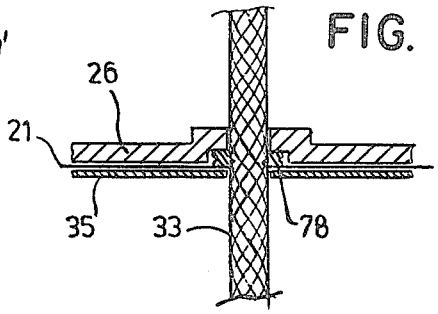
FIG. 8 is a detail showing the fixture of one of the lengths of cord to the housing half illustrated in FIG. 5.

After this, the two ends of the cord 33 pass through the two corresponding orifices in the other backing plate 35 (FIG. 6) before being threaded through the last pair of holes in a region of the periphery of the mouth of the bag opposite to that where the half 25 of the device is assembled. At the same time, the head 39' of the pin 36 passes through the larger section of opening 38 in the backing plate 35 and through the corresponding opening in the periphery of the bag before being displaced upwards so that its body is received in the narrow portion of opening 38. A metal ring 76 is then placed over each of the ends of the cord and, at suitable distances from these ends, the rings are crimped for the purpose of defining a fixed stop in each length of cord (FIG. 8). Finally, the ends of the cord are threaded through the respective orifices 32 in the rear half 24 and the assembly comprising half 24, the mouth of the bag, pin 36 and backing plate 35, is fixed by means of rivets 31 (FIG. 14) applied through the orifices 30 and 37 and also the corresponding holes in the bag. As illustrated in FIG. 8, the rings 76 are received in recesses around the orifices 32 in rear half 24, and since their diameters are larger than both the orifices 32 and the corresponding orifices in the backing plate 35, the two lengths of cord will be anchored in half 24. On completing the assembly of half 24 for applying the rivets 31, the head 39' of pin 36 positions itself in the cavity 34. The two free ends of cord 33 can then be joined in any suitable manner as at 77.

Referring now to FIG. 13, a label holder 23 shown therein comprises a tough plastic base 78, and a superimposed sheet of transparent plastic 79, electronically welded along three of its edges to base 78 in a way that a piece of paper, in the form of a label, can be placed between the base 78 and the sheet 79, entering below the upper unwelded edge 80. It should be observed that the upper end of base 78 is trapezoidal to conform with the first cavity 47 in front half 25 which is also defined by the metallic plate 49 on one side and by the plate 59 on the other. The upper part of base 78 of label holder 23 is also formed with a rectangular opening 81 which, when the label holder is fitted in the said cavity 47, will be aligned with the cavity 55 in front half 25 and the openings 65 and 62 in the two above mentioned metal plates. It should also be observed that when the label holder is correctly positioned in the cavity 47, the upper welded edge 80 of sheet 79 is maintained within the cavity, it therefore being impossible to remove the label without first withdrawing the label holder 23 from the cavity.

Figure 15:
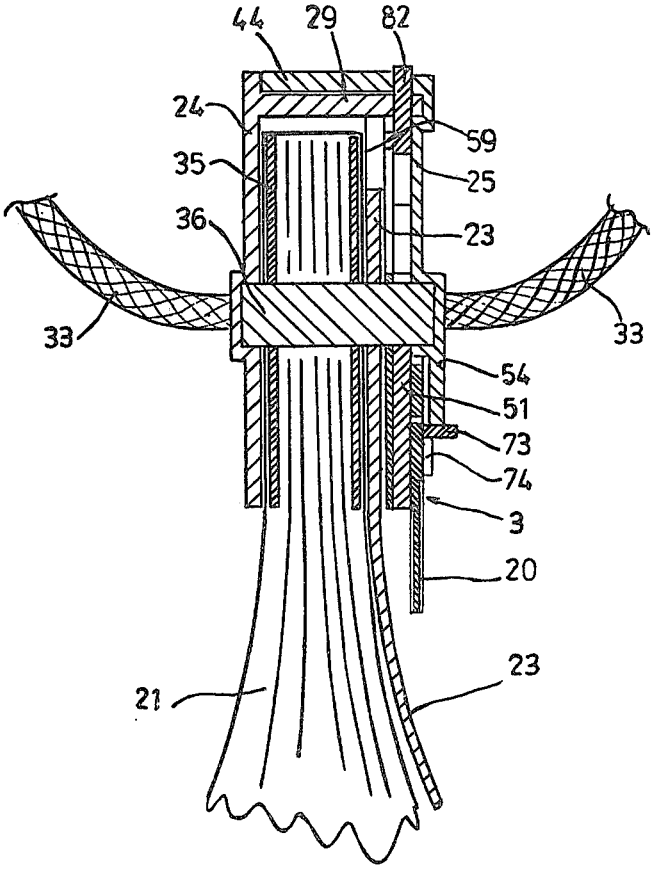
FIG. 15 is a central vertical section of the bag closure device of FIG. 4, in the closed condition.

For the purpose of closing the bag 21, it should first be ascertained that the slide 51 is open (displaced downwardly) and the label holder 23 is then fitted into cavity 47 so as to align the rectangular openings 62 and 65 in the two metal plates. The loop of cord which projects from the front half 25 of the device 22 is then taken in one hand. With the other hand held against the front half 25 of the device, the cord is pulled so that the two halves 24 and 25 are brought together, compressing the mouth of the bag in a manner somewhat similar to an accordion, as indicated in FIG. 14. During this operation, the slide 51 is in its lower or withdrawn position with the pin 68 against the bottom of the slit 67 in metal plate 49. This aligns head 39 of the pin 36, the two openings 62 and 65 in the cavity 55, with the medium width portion 71 of opening 69 in the slide. When the ends 43 of flange 27 of rear half 24 and its projection 28 are completely fitted in the channel 42 and hollow projection 44 of front half 25, the head 39 of pin 36 will have passed through the various openings to become housed in cavity 55. In this state, slot 45 in the projection 44 and slot 29 in the projection 28 are aligned with each other and also with the cavity 50 containing the slide 51. By applying the thumb against projection or bridge 73, the slide may now be pushed upwards until the said projection abuts against the front face of the cavity of the capsule 54 (FIG. 15). For the purpose of achieving this position, the two halves have to be correctly closed because it is necessary that the upper end of the slide 51 pass through the two aligned slots 29 and 45 until it appears at 82 (see FIG. 5). In this position the rectangular opening in bridge 73 is aligned with the entrance to the capsule 54, so that seal 3 (FIGS. 2 and 4) can be applied through the said openings. In this position the slide 51 is locked in place by the seal and the head 39 of pin 36 is locked in the interior of the cavity 55 due to the fact that it is too wide to pass through the narrowest section 72 of the opening 69 in the slide. The bag 21, thus closed and sealed, can then be carried using the two loops of cord 33.

When it is desired to open the bag, it is only necessary to pull and twist sideways the blade portion 20 of the seal 3 to break the weakenings 19, to withdraw the slide 51 until the pin 68 again bottoms in slot 67 in metal plate 49 and afterwards to separate the two halves 24 and 25 holding the rear loop of the cord 33 (FIG. 3) with one hand and the protuberances 46 on front half 25 with the other. It should be observed that, in this state, the mouth of the bag will be totally open and will tend to maintain its configuration without collapsing due to the presence of the thick cord 33 threaded along its edges. The barb or head 18 of the seal 3, which remained in the interior of the capsule 54 with the bottom closed by slide 51, may now fall into the interior of the bag, because the withdrawal of the slide aligns the interior of the same capsule with the larger section 70 of opening 69 and also with the two orifices 66 and 63 in the metal plates 49 and 59.

All the components illustrated in the drawings are, preferably, molded from plastic material with the exception of the two backing plates 35 and 59 (FIGS. 6 and 12) and plate 49 (FIG. 10) which serves as a bed for the slide 51 and, obviously, the rivets.

Although the bag closing device 2 in FIGS. 1 and 3 has been illustrated without a label it will be obvious to persons skilled in the art that the same can be formed to receive a label holder in a way similar to the preferred embodiment of FIGS. 4 and 15. It will also be understood that the two embodiments described and illustrated are only illustrative examples of the broader idea of this invention, there being an infinity of modifications and substitutions without departing therefrom. The scope of the invention is therefore as defined in the following claims.

I claim:

1. Device for the inviolable closing of bags comprising a housing having a top wall, first and second larger opposite side walls and first and second smaller opposite side walls, with an open bottom destined to receive the mouth of a bag in a folded condition, at least one rod having a length at least equal to the separation between said two larger walls, the said larger walls of the housing being formed with respective first and second aligned openings dimensioned to receive the said rod, and immobilizing means permitting substantial immobilization of said rod with respect to said two larger walls and comprising seal receiving means in the form of a rectangular bridge at one end of said rod defining a rectangular opening transverse with relation to the length of said rod and an outer capsule on said second larger side wall of said housing, said capsule covering said second opening and being formed with a lateral rectangular opening, said lateral rectangular opening of said capsule being aligned with said rectangular opening of said bridge when in the immobilized position to receive a security seal inserted through said rectangular openings in the capsule and the bridge.

2. Device according to claim 1 in which said two rectangular openings are substantially of the same size.

3. Device according to claim 2 including an elongated flexible strap provided at one end with said rod and, at the other, with a hollow guide for the rod, said top of said housing having a slit adjacent the upper edge of said second larger side wall in a way that its end provided with the rod stays outside the first larger side wall of the housing and its end with the guide stays inside the second larger side wall, being slidable below and outside the housing.

4. Device according to claim 3 in which said guide is a tube dimensioned to receive said rod and having a length equal to the distance between the internal surfaces of said larger side walls of the housing.

5. A bag provided with a device for its inviolable closure, said device comprising a housing having a top wall, first and second larger opposite side walls, first and second smaller opposite side walls and an open bottom, said first and second larger side walls being portions of first and second separable halves of said housing for receiving and being fixed to the mouth of the bag, two lengths of cord permanently associated with said first larger side wall and passing generally parallel to said top wall and freely through respective series of orifices formed in opposite extensions of the mouth of said bag and then through respective openings in said second larger side wall of said housing, said housing halves being fixed to the mouth of the bag at opposite extensions thereof between said two series of orifices, and immobilizing means in said two halves which permit said halves to be locked together to substantially immobilize said larger side walls.

6. Device according to claim 5 in which immobilizing means comprise a pin having a first end permanently mounted in said first half of the housing and a second end having locking means, and a locking member in said second half, said locking member being cooperable with said locking means on the pin, when the two halves are in the closed position.

7. Device according to claim 6, in which said locking means on the pin comprises a portion of greater cross section at its second end, the locking member being displaceable to a position behind the said portion so as to prevent movement of separation of the two halves.

8. Device according to claim 7 in which said locking member comprises an elongated plate slidingly received in a cavity in said second half and having an opening having at least two width dimensions, a first said width dimension being larger to allow passage of said greater cross section portion at the second end of said pin and a second smaller width dimension insufficient to permit passage of said portion but sufficient to accommodate the section of the pin immediately therebehind, said plate being displaceable between a free position which presents said first larger dimension to the pin and a locked position which presents said second smaller dimension to the pin.

9. Device according to claim 8, in which said second flange is formed with a slot aligned with said locking plate for receiving said plate in the locked position, and said first flange is formed with a through slot which aligns with said slot in said second flange when in the closed position of said two halves so that said locking plate passes through said through slot in said locked position.

10. Device according to claim 7 or 8, in which the locking member is formed with a rectangular opening which, in said locked position, is aligned with another rectangular opening formed in said second half of the housing, permitting the application of a security seal through said two rectangular openings for sealing said locking member in said locked position.

11. Device according to claim 10, in which said second flange is formed with a slot aligned with said locking plate for receiving said plate in the locked position, and said first flange is formed with a through slot which aligns with said slot in said second flange when in the closed position of said two halves so that said locking plate passes through said through slot in said locked position.

12. Device according to claim 10, in which said first half of the housing comprises said first larger wall and a continuous first peripheral flange substantially at right angles thereto, along the side and top edges of said first larger wall, and said second half of the housing comprises said second larger wall and a continuous second peripheral flange substantially at right angles thereto along the side and top edges of said second larger wall, said first and second flanges being so dimensioned that on placing said two halves together, said first flange is received telescopically within said second flange which defines said top wall and said pin of smaller side walls of said housing.

13. Device according to claim 12, further comprising a substantially flat label holder, an opening in one end of the label holder suitably dimensioned for the passage of said pin therethrough, and a cavity in the second half of the housing for receiving the label holder with said opening in said one end aligned with the pin during closure of the device.

14. Device according to claim 12, in which said bag is made of electronically welded reinforced plastic.

* * * * *